US009885334B2

(12) United States Patent
Jaros et al.

(10) Patent No.: US 9,885,334 B2
(45) Date of Patent: Feb. 6, 2018

(54) ELECTRIC MACHINE IN A MOTOR VEHICLE HAVING A ROTATIONAL SPEED SIGNAL INPUT

(71) Applicant: Robert Bosch GmbH, Stuttgart (DE)

(72) Inventors: Rolf Jaros, Backnang (DE); Nikolas Poertner, Stuttgart (DE); Axel Reuter, Vaihingen an der Enz (DE); Alexander Trofimov, Ludwigsburg (DE)

(73) Assignees: ROBERT BOSCH GMBH, Stuttgart (DE); SEG AUTOMOTIVE GERMANY GMBH, Stuttgart (DE)

( * ) Notice: Subject to any disclaimer, the term of this patent is extended or adjusted under 35 U.S.C. 154(b) by 300 days.

(21) Appl. No.: 14/197,860

(22) Filed: Mar. 5, 2014

(65) Prior Publication Data

US 2014/0265332 A1 Sep. 18, 2014

(30) Foreign Application Priority Data

Mar. 12, 2013 (DE) ..... 10 2013 204 200

(51) Int. Cl.
*F02N 11/00* (2006.01)
*F02N 15/04* (2006.01)
*F02N 11/08* (2006.01)

(52) U.S. Cl.
CPC ..... *F02N 11/00* (2013.01); *F02N 11/006* (2013.01); *F02N 15/04* (2013.01); *F02N 2011/0896* (2013.01); *F02N 2200/041* (2013.01); *F02N 2300/102* (2013.01)

(58) Field of Classification Search
CPC ..... F02N 15/066; F02N 15/06; F02N 11/00
USPC ..... 290/48
See application file for complete search history.

(56) References Cited

U.S. PATENT DOCUMENTS 3,888,325 A * 6/1975 Reinbeck ..... B60K 6/48 180/65.25
5,847,470 A * 12/1998 Mitchell ..... B60K 6/00 180/65.23
5,917,248 A * 6/1999 Seguchi ..... B60K 6/26 290/31
5,967,940 A * 10/1999 Yamaguchi ..... B60K 6/24 477/107
6,335,609 B1 1/2002 Amey et al.
6,561,336 B1 * 5/2003 Huart ..... F02B 63/04 123/179.28

(Continued)

FOREIGN PATENT DOCUMENTS

CN 1477302 A 2/2004
CN 102180167 A 9/2011

(Continued)

*Primary Examiner* — Tulsidas C Patel
*Assistant Examiner* — Charles Reid, Jr.
(74) *Attorney, Agent, or Firm* — Norton Rose Fulbright US LLP; Gerard Messina

(57) ABSTRACT

A method for operating an electric machine coupled to an internal combustion engine in a motor vehicle, the electric machine having a stator winding, a rotor winding, a field regulator assigned to the rotor winding and a current converter post-connected to the stator winding having controllable switching elements, in which during a starting process of the internal combustion engine the electric machine is operated as a motor according to a rotational speed specification signal.

15 Claims, 2 Drawing Sheets

(56) References Cited

U.S. PATENT DOCUMENTS 6,807,476 B2 * 10/2004 Ando ..... B60K 6/24 123/179.4
7,150,254 B2 * 12/2006 Ichimoto ..... B60K 6/445 123/179.16
7,174,714 B2 * 2/2007 Algrain ..... F02D 37/00 290/40 A
7,341,035 B2 3/2008 Kassner et al.
7,363,122 B2 * 4/2008 Bischoff ..... B60K 6/48 180/65.31
7,751,965 B2 * 7/2010 Ando ..... F02P 5/1506 123/179.3
8,253,359 B2 * 8/2012 Tanaka ..... B60K 6/365 180/65.285
8,916,990 B2 * 12/2014 Tarchinski ..... B60L 3/04 307/10.1
2003/0154945 A1 * 8/2003 Ando ..... B60K 6/445 123/179.3
2005/0216176 A1 * 9/2005 Ichimoto ..... F02D 41/065 701/112
2006/0150937 A1 * 7/2006 Lupo ..... F02D 41/042 123/179.4
2006/0273592 A1 * 12/2006 Yamabuchi ..... H02M 7/003 290/40 C
2008/0169138 A1 * 7/2008 Grand ..... B60K 6/48 180/65.265
2008/0203730 A1 * 8/2008 Fahrenbach ..... F03D 1/00 290/44
2009/0030595 A1 * 1/2009 Sugai ..... B60K 6/445 701/112
2009/0256513 A1 * 10/2009 Ando ..... B60K 6/445 318/478
2009/0309364 A1 * 12/2009 Marconi ..... B64D 41/00 290/52
2010/0295302 A1 * 11/2010 Martin ..... F03B 17/06 290/43
2012/0007360 A1 * 1/2012 Anghel ..... F02C 7/268 290/31
2013/0049460 A1 * 2/2013 Herbig ..... H02P 9/48 307/10.1

FOREIGN PATENT DOCUMENTS

CN 102612594 A 7/2012
CN 102958772 A 3/2013
DE 19852085 C1 2/2000
DE 10317092 A1 11/2004
DE 10359486 A1 7/2005
DE 102004037167 A1 3/2006
DE 102007005240 A1 8/2008
JP 08126115 A 5/1996
WO 2013000676 A2 1/2013

* cited by examiner

ELECTRIC MACHINE IN A MOTOR VEHICLE HAVING A ROTATIONAL SPEED SIGNAL INPUT

RELATED APPLICATION INFORMATION

The present application claims priority to and the benefit of German patent application no. 10 2013 204 200.0, which was filed in Germany on Mar. 12, 2013, the disclosure of which is incorporated herein by reference.

FIELD OF THE INVENTION

The present invention relates to a method for operating an electric machine coupled to an internal combustion engine in a motor vehicle, an arithmetic unit for carrying out the method, as well as a correspondingly equipped electric machine.

BACKGROUND INFORMATION

Electric machines for use in motor vehicles have long been known in the form of the starter or starter motor and the generator. In modern vehicles, one may use alternating-current generators of claw pole configuration having electrical external excitation. For the rectification of the alternating current generated, rectifiers based on semiconductor diodes are normally used.

Because of the increasing requirements for electrical energy in the vehicle, the endeavor to reduce fuel consumption and lower emissions as well as the desire to combine the advantages of an electric motor with those of an internal combustion engine, electric machines having a double function, so-called starter-generators, may be used.

Starter-generators (SG) are electric machines that are able to be operated in a vehicle, according to requirement, as an electric motor or as a generator. As a generator, starter-generators have to be able to assume all the tasks which are conventionally assigned to the generator, namely, the electrical supply of the vehicle electrical system and charging the vehicle's battery. As an electric motor, at the start of the internal combustion engine, starter-generators have to bring its crankshaft to the required starting rotational speed in a short time.

The use of starter-generators is not, however, limited to the functions named. At a correspondingly large nominal capacity, a starter-generator, in motor operation, is able to support the internal combustion engine in driving, for instance, in accelerating in a so-called boost operation and for turbolag compensation. During braking, a part of the braking energy may be recuperated by a generator operation of a starter-generator, Corresponding drives are designated as hybrid drives, and corresponding systems as boost recuperation systems (BRS).

It would be desirable to improve the starting process of the internal combustion engine having such electric machines.

SUMMARY OF THE INVENTION

The present invention provides a method for operating an electric machine coupled to an internal combustion engine in a motor vehicle, having the features described herein. Advantageous refinements are the subject matter of the following further descriptions herein.

The present invention provides for operating a conventional electric machine (particularly having a claw pole configuration) so that the starting process of the internal combustion engine is improved. The electric machine is particularly a starter-generator (for instance, a belt operated starter-generator, RSG) or the electric machine of a BRS (also designated as boost recuperation machine, BRM). The electric machine is equipped to be operated as a motor during the starting process of the internal combustion engine, according to a rotational speed specification signal. On the one hand, this measure leads to an increase in usable starting torque. The starting process becomes more comfortable (e.g. reduction in vibrations) and speeded up. On the other hand, it leads to a rotational speed stabilization of the internal combustion engine and thereby to a reduction in emissions. In particular, a catalyst heating phase may be speeded up after the start of the internal combustion engine, since the internal combustion engine operation is able to be optimized completely for this since rotational speed ovalities do not have to be held low by the internal combustion engine itself.

The operation as motor of the electric machine, during the starting process of the internal combustion engine, also permits evacuating the air from the intake manifold by dragging the internal combustion engine, until a charging desired for ignition is achieved. The charging, in this context, is able to take place while taking into account certain points, such as an emission-optimized start by emission-optimized combustion(s), a comfort start by minimum torque difference during the use of combustion and thus the minimization of jerking, rapid starting time, low noise development when using the combustion.

The present invention develops particular advantages in simple electric machines (especially SG or BRM) for starting, for electrically supported internal combustion engine driving, for recuperation and/or for current generation, which, within the scope of the present invention, are broadened by advantageous operating functionalities.

According to one further specific embodiment, the rotational speed specification signal includes a target rotational speed signal, the electric machine being equipped to work as a motor and to achieve the target rotational speed, wherein subsequently, in a rotational speed control operation, the actual rotational speed of the electric machine (and with that of the internal combustion engine) are controlled to the target rotational speed. For the sake of completeness, we should mention that, in the rotational speed control operation, the electric machine is able to be operated as a motor (rotational speed is to increase) and as a generator (rotational speed is to drop off). This leads to a rotational speed stabilization of the internal combustion engine during the starting process and subsequently to it. Vibrations are reduced. The rotational speed stabilization enables the operation of the internal combustion engine at operating points which would not be accessible without the rotational speed stabilization, in particular, operating points being possible having reduced emissions. It may further be provided that the electric machine, after being turned on, up to reaching the target rotational speed, follow a specified rotational speed curve or torque curve.

According to a further specific embodiment, the rotational speed specification signal includes a lower rotational speed threshold signal, the electric machine being equipped to drive the internal combustion engine upon the reaching or exceeding of the lower rotational speed threshold. This particularly permits the use of the electric machine, together with a conventional starter, such as a pinion starter (a so-called "Kombistart" (combination start)) which leads to an increase in the usable starting torque. It may further be provided that the electric machine after being turned on, that is, after reaching or exceeding the lower rotational speed threshold, follows a specified rotational speed curve or torque curve (additional explanations on this may be found below). According to such an embodiment, the super-ordinated engine control unit (ECU) first activates the conventional starter and communicates to the electric machine the lower rotational speed threshold. As soon as the lower rotational speed threshold has been achieved, the electric machine takes up a motor operation and also drives the internal combustion engine. The activation of the electric machine may take place while taking into account latencies which are caused by delays because of signal and communication path lengths (such as, for instance, CAN propagation times, relay switching delays), so that the turning on of the electric machine takes place at the desired time and/or after the detection of the engaging (for instance, by recording the rotational speed, the current and/or the voltage) of a pinion starter as a conventional starter.

According to another specific embodiment, the rotational speed specification signal includes a selection signal, the electric machine being equipped, according to the selection signal, to follow one of a plurality of predetermined rotational speed curves (rotational speed plotted against time) or torque curves (torque plotted against rotational speed, torque plotted against time). Several curves may be available, so that, for example, one is able to choose between a quick start (shorter starting time, more vibrations and noise) and a comfort start (longer starting time, fewer vibrations, less noise). The curves may be stored in the arithmetic unit of the electric machine, and may be selected there.

In the selection of the curve, one or more boundary conditions are expediently taken into account, particularly admissible vibrations of the internal combustion engine while starting in relation to the starting time, the comfort desired (noise, vibrations) in relation to the starting time, the temperature of the internal combustion engine (cold start, warm start, combination start with pinion starter). Since the required starting torque for an internal combustion engine rises with decreasing temperature (based on higher friction, e.g. because of higher viscosity of the engine oil), combination starts (electric machine and pinion engaged at the start) are important particularly for cold temperatures so as to keep up the starting capability. But even in the case of correspondingly large engines (ca. >2 l displacement) it may happen that the starting torque of the electric machine is not sufficient, and support using the ritzel starter becomes necessary.

According to a further specific embodiment, the rotational speed specification signal includes a start signal, the electric machine being equipped to start after receiving the start signal of the internal combustion engine. In this context, the electric machine may be following a specified rotational speed curve or torque curve selected using the selection signal.

Only for the sake of completeness, it should be mentioned that the rotational speed specification signal is able to include one or more of the signals described.

The functions according to the present invention, initiated by the rotational speed specification signal, and their execution on the electric machine, may be interrupted as required by the superordinated controller (such as the engine control unit.)

The rotational speed control operation of the electric machine may be in each case first terminated when the rotational speed of the internal combustion engine reaches a rotational speed stabilization threshold, that is, when the internal combustion engine runs in a sufficiently "round" manner.

For example, a rotational speed fluctuation (for instance, having a control error of the rotational speed control) may be valued after the start (i.e. when injection release and ignition release have taken place), and the rotational speed control operation of the electric machine may first be terminated when the rotational speed fluctuation is below a rotational speed fluctuation threshold. For instance, after the starting, a catalyst heating phase may follow. In it, the internal combustion engine is operated so that as hot as possible an exhaust gas flow comes about. This has a negative effect, however, on the rotational speed stability and leads to an irregular rotational speed curve of the internal combustion engine. According to the present invention, this may be countered by rotational speed stabilization using the electric machine. Because of the rotational speed threshold stabilization, an optimization of the internal combustion engine operation may take place completely based on a high exhaust gas temperature.

An arithmetic unit according to the present invention, such as a control unit of an electric machine, is equipped, particularly from a programming technology point of view, to carry out a method according to the present invention. The arithmetic unit may form a structural unit with the electric machine, in order, in an overall manner, to form an "intelligent" electric machine.

The implementation of the method in the form of software is also advantageous, since this causes particularly low costs, especially if an executing control unit is also used for additional tasks and is therefore present anyway. Suitable data carriers for providing the computer program are, in particular, diskettes, hard disks, flash memories, EEPROM's, CD-ROM's, DVD's and other similar ones. A download of a program via computer networks (Internet, intranet, etc.) is also possible.

Further advantages and developments of the present invention are derived from the description and the accompanying drawings.

It is understood that the features mentioned above and the features yet to be described below may be used not only in the combination given in each case but also in other combinations or individually, without departing from the scope of the present invention.

The present invention is represented schematically in the drawings in light of exemplary embodiments and described in detail below with reference to the drawings.

DETAILED DESCRIPTION

Figure 1:
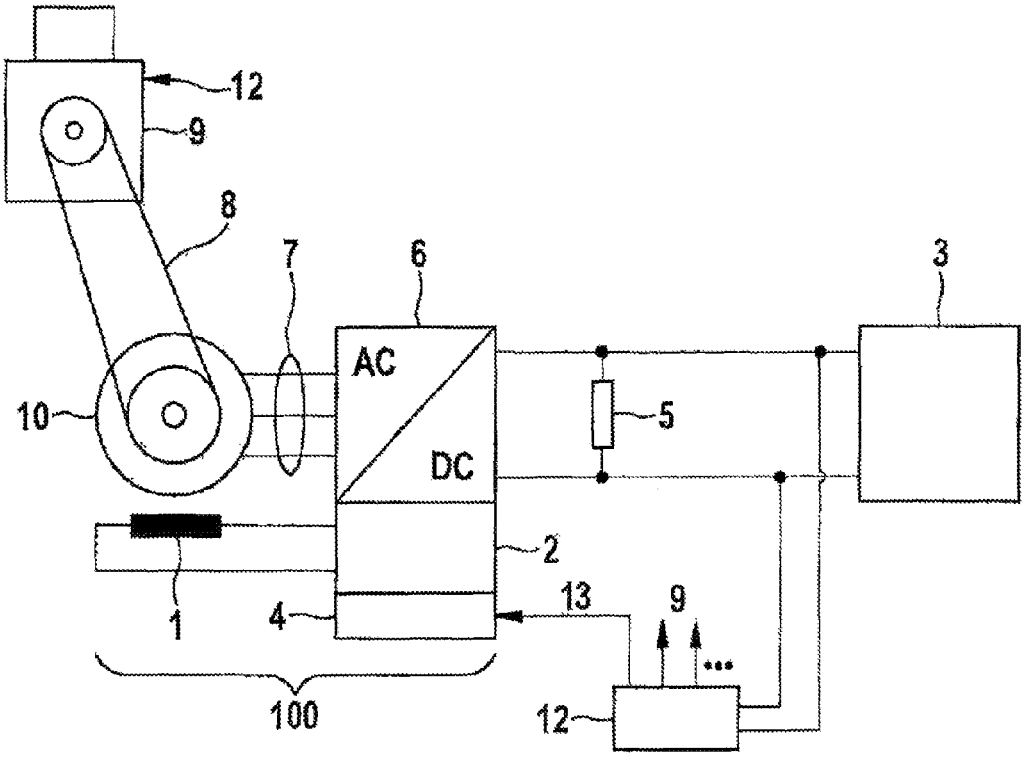
FIG. 1 shows a vehicle electrical system having an energy supply unit which may be developed and/or operated according to one specific embodiment of the present invention.

FIG. 1 shows a vehicle electrical system of a motor vehicle having an electric machine 100, which may be developed and/or operated according to one specific embodiment of the present invention. Electric machine 100 is developed, for example, as an externally excited synchronous machine, for instance, of claw pole configuration.

The electric machine is connected to an internal combustion engine 9 in a manner transmitting torque, via an appropriate coupling arrangement, such as a mechanical connection 8 in the form of a belt drive. The electric machine has a stator winding 10.

Electric machine 100 has a current converter 6, a plurality of phase connections 7 being provided, corresponding to the number of the phases provided by electric machine 100. Current converter 6 has active switching elements (e.g. MOSFET) and may be operated as a rectifier (generator operation of the electric machine) or as an inverter (motor operation of the electric machine). Current converter 6 has a control unit for actuating the active switch elements.

On the direct voltage side, a rotor winding 1 is connected to electric machine 100 via a field regulator 2. Field regulator 2 is provided to control rotor winding 1.

At least one energy store 3, such as a vehicle battery, and at least one energy consumption device 5 are also connected on the direct voltage side.

Electric machine 100 also has an arithmetic unit 4, which is equipped with programming technology to carry out the present invention. In particular, it controls field regulator 2 and current converter 6 according to the present invention. Arithmetic unit 4 particularly has an input 13 or an interface 13 for receiving a rotational speed specification signal. This may, for instance, be a vehicle bus connection, such as a CAN bus. The arithmetic unit 4 is a component of electric machine 100 and forms a structural unit with it.

In the vehicle electrical system there is also provided engine control unit 12 (ECU), which, among other things, controls internal combustion engine 9 and arithmetic unit 4 of electric machine 100, and transmits to it particularly corresponding operating commands including the rotational speed specification signal for starting internal combustion engine 9.

Exemplary operating modes will be explained below, with reference to FIGS. 2 and 3.

Figure 2:
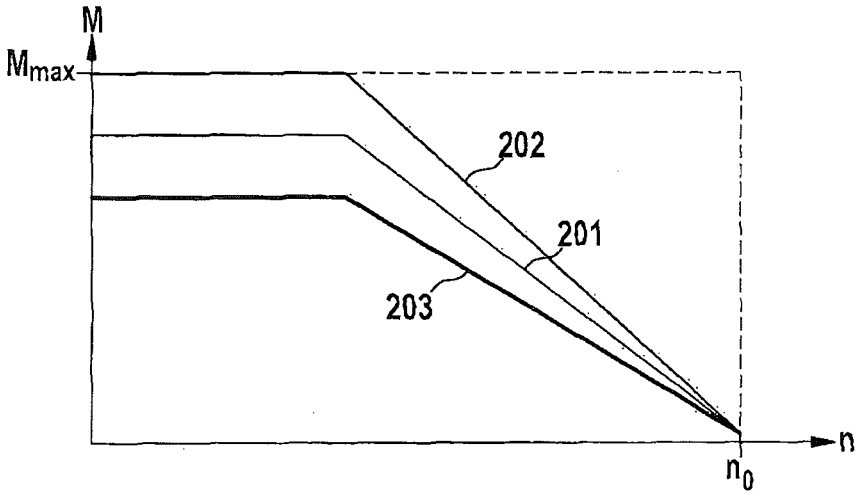
FIG. 2 shows three exemplary torque curves plotted against the rotational speed, which are able to be selected according to one embodiment of the present invention.

In FIG. 2, three different curves 201, 202, 203 of torque M, given off by the electric machine, are plotted against rotational speed n of the electric machine. These are exemplary torque curves, which are selected from engine control unit 12 by using a rotational speed specification signal including a selection signal, and are subsequently executed automatically and independently by arithmetic unit 4 of electric machine 100. For this purpose, arithmetic unit 4 of electric machine 100 controls field regulator 2 and current converter 6, in such a way that the selected curve is produced.

Curve 201, for instance, is a normal curve, curve 202 is a curve for an accelerated start (having an increased torque) and curve 203 is a curve for a comfort start (having a decreased torque.) As an example, a target rotational speed $n_0$ is provided, and when this is reached, an injection release and an ignition release take place by engine control unit 12, and with that, the starting process of the internal combustion engine is closed. The motor operation of electric machine 100 is then ended. According to one advantageous refinement, the electric machine may continue to be operated in a rotational speed control operation, the rotational speed control operation of electric machine 100 being terminated only when a sufficient rotational speed stability of the internal combustion engine has been reached.

Figure 3:
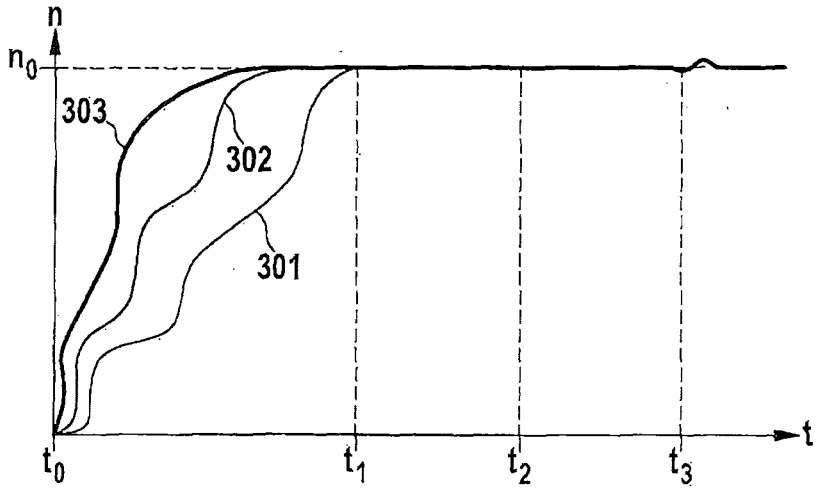
FIG. 3 shows three exemplary rotational speed curves plotted against time, which are able to be selected according to one embodiment of the present invention.

In FIG. 3, three different curves 301, 302, 303 of a rotational speed n of the electric machine are plotted against a time t. The different curves may, for example, result from curves 201, 202 or 203 executed by the electric machine. As an example, target rotational speed $n_0$ is given again. The starting process of the internal combustion engine begins at a point $t_0$, at which engine control unit 12 transmits a rotational speed specification signal including a start signal to arithmetic unit 4 of electric machine 100. The rotational speed specification signal also includes a target rotational speed signal. The target rotational speed is $n_0$ at this point. The rotational speed specification signal may also include a selection signal in addition, in order to select one of curves 2301, 302 and 303. Thereafter, arithmetic unit 4 of electric machine 100 begins automatically and independently to turn on the internal combustion engine.

At a time $t_1$ target rotational speed $n_0$ is reached. Subsequently, arithmetic unit 4 goes over into a control operation, and controls the actual rotational speed of the electric machine to the target rotational speed $n_0$. Up to a time $t_2$, the air is evacuated from the intake manifold, which may be by the dragging of the internal combustion engine, until a charging desired for ignition is reached. Thus, in this case, the electric machine is used to set the desired target charging at the time of using the combustion. In this context, the rotation of the electric machine may be controlled in such a way that an optimization of the desired target charging under certain points of view takes place, such as an emission-optimized start by emission-optimized combustion(s), a comfort start by minimum torque difference during using of the combustion and thereby minimizing jerking, a rapid starting time, a low noise development when setting the combustion.

At a point $t_3$, the desired target charging has been reached, and an injection (in direct-injection engines) is released. In this context, the rotation of the electric machine may be controlled in such a way that an optimization of the desired target charging from certain points of view takes place, such as a reduction in harmful emissions during the first combustion and the avoidance of overshooting/undershooting during activation of the injection. The internal combustion engine is ignited. The electric machine continues to be operated in the rotational speed control operation, in order to achieve a rotational speed stabilization (e.g. during a catalyst heating phase.)

At a time $t_4$, the start of internal combustion engine 9 has been concluded and the rotational speed is sufficiently stable. The rotational speed control operation of the electric machine is terminated. The rotational speed is now determined by the internal combustion engine, which is controlled by engine control unit 12.

What is claimed is:

1. A method for operating an electric machine coupled to an internal combustion engine in a motor vehicle, the method comprising:

operating, during a starting process of the internal combustion engine, the electric machine as a motor according to a rotational speed specification signal;

wherein the electric machine includes a stator winding, a rotor winding, a field regulator assigned to the rotor winding and a current converter post-connected to the stator winding having controllable switching elements.

2. The method of claim 1, wherein the rotational speed specification signal includes a target rotational speed signal, and wherein the actual rotational speed of the electric machine is regulated to a target rotational speed specified by the target rotational speed signal.

3. The method of claim 2, wherein the regulation of the actual rotational speed of the electric machine to the target rotational speed specified by the target rotational speed signal is terminated when a rotational speed of the internal combustion engine reaches a rotational speed stability threshold.

4. The method of claim 1, wherein the rotational speed specification signal includes a lower rotational speed threshold signal, and wherein the electric machine is operated as a motor only when a rotational speed of the electric machine reaches a lower rotational speed threshold specified by the lower rotational speed threshold signal.

5. The method of claim 4, wherein the internal combustion engine is turned on by a starter that is different from the electric machine.

6. The method of claim 5, wherein turning on the electric machine takes place while taking into account a latency.

7. The method of claim 1, wherein the rotational speed specification signal includes a selection signal, so as to select a specified rotational speed curve or a torque curve to be followed by the electric machine.

8. The method of claim 1, wherein the operation as a motor of the electric machine is terminated when a rotational speed of the internal combustion engine reaches a rotational speed stability threshold.

9. The method of claim 1, wherein a starter-generator or a boost-recuperation machine is operated as the electric machine.

10. An arithmetic unit for operating an electric machine coupled to an internal combustion engine in a motor vehicle, comprising:

an arithmetic arrangement which is configured to operate, during a starting process of the internal combustion engine, the electric machine as a motor according to a rotational speed specification signal;

wherein the electric machine includes a stator winding, a rotor winding, a field regulator assigned to the rotor winding and a current converter post-connected to the stator winding having controllable switching elements.

11. A non-transitory computer readable medium having a computer program, which is executable by a processor, comprising:

a program code for operating an electric machine coupled to an internal combustion engine in a motor vehicle, by operating, during a starting process of the internal combustion engine, the electric machine as a motor according to a rotational speed specification signal;

wherein the electric machine includes a stator winding, a rotor winding, a field regulator assigned to the rotor winding and a current converter post-connected to the stator winding having controllable switching elements.

12. The non-transitory computer readable medium of claim 11, wherein the rotational speed specification signal includes a target rotational speed signal, and wherein the actual rotational speed of the electric machine is regulated to a target rotational speed specified by the target rotational speed signal.

13. An electric machine for use in a motor vehicle for coupling to an internal combustion engine, comprising:

a stator winding;

a rotor winding;

a field regulator assigned to the rotor winding; and a current converter, which is post-connected to the stator winding, having controllable switching elements and an arithmetic unit;

wherein the arithmetic unit includes an arithmetic arrangement being configured to operate, during a starting process of the internal combustion engine, the electric machine as a motor according to a rotational speed specification signal.

14. The electric machine of claim 13, further comprising:

an input for receiving the rotational speed specification signal.

15. A vehicle electrical system of a motor vehicle, comprising:

an engine control unit to control the internal combustion engine and to output a rotational speed specification signal; and an electric machine for use in a motor vehicle for coupling to an internal combustion engine, including:

a stator winding;

a rotor winding;

a field regulator assigned to the rotor winding; and a current converter, which is post-connected to the stator winding, having controllable switching elements and an arithmetic unit;

wherein the arithmetic unit includes an arithmetic arrangement being configured to operate, during a starting process of the internal combustion engine, the electric machine as a motor according to a rotational speed specification signal.

* * * * *